US006544368B1

(12) United States Patent
Yates

(10) Patent No.: US 6,544,368 B1
(45) **Date of Patent: *Apr. 8, 2003**

(54) METHOD OF APPLYING PRINT TO AN ELASTOMER AND DECORATIVE ELASTIC CUSHION

(76) Inventor: Paul M. Yates, 5814 Briar Tree Dr., LaCanada, CA (US) 91011

( * ) Notice: Subject to any disclaimer, the term of this patent is extended or adjusted under 35 U.S.C. 154(b) by 106 days.

This patent is subject to a terminal disclaimer.

(21) Appl. No.: 09/656,341

(22) Filed: Sep. 6, 2000

Related U.S. Application Data

(62) Division of application No. 09/286,948, filed on Apr. 8, 1999, now Pat. No. 6,314,598.

(51) Int. Cl.[7] ..... B44C 1/165; B29C 39/12; C04B 41/00

(52) U.S. Cl. ..... 156/230; 264/247; 264/132; 264/296; 156/245

(58) Field of Search ..... 264/245, 246, 264/247, 255, 132, 510, 129; 156/230, 240, 241, 247, 277, 289, 245; 427/146, 147, 148; 269/296

(56) References Cited

U.S. PATENT DOCUMENTS 2,948,651 A * 8/1960 Waag ..... 156/79
3,122,598 A * 2/1964 Berger ..... 264/132
4,038,123 A * 7/1977 Sammis ..... 101/129
4,089,919 A * 5/1978 Sanson ..... 264/259
4,105,734 A * 8/1978 Nakagawa ..... 156/230
4,209,486 A * 6/1980 Ross ..... 264/132
4,213,926 A * 7/1980 Toyoda et al. ..... 156/232
4,327,121 A * 4/1982 Gray, III ..... 156/247
4,537,739 A * 8/1985 Ruhl ..... 264/247
5,142,722 A * 9/1992 Kolb ..... 8/471
5,407,510 A * 4/1995 Marfilius et al. ..... 156/212
5,441,676 A * 8/1995 Bigolin ..... 264/255
5,527,407 A * 6/1996 Gartland et al. ..... 156/116
5,679,193 A * 10/1997 Yates ..... 156/145
5,840,225 A * 11/1998 Kikuchi et al. ..... 156/79
5,952,070 A * 9/1999 Depiero ..... 248/205.3
5,980,143 A * 11/1999 Bayer et al. ..... 248/118.1
6,089,516 A * 7/2000 Yates ..... 248/118
6,245,182 B1 * 6/2001 Nakamura ..... 156/212
6,314,598 B1 * 11/2001 Yates ..... 156/84
6,346,316 B1 * 2/2002 Saito et al. ..... 428/195
6,352,658 B1 * 3/2002 Chang et al. ..... 264/255

* cited by examiner

*Primary Examiner*—Jan H. Silbaugh
*Assistant Examiner*—Geoffrey P. Shipsides
(74) *Attorney, Agent, or Firm*—Walter A. Hackler

(57) ABSTRACT

A decorative elastic cushion is manufactured with an elastomer having the physical properties of flexibility and compressibility in a range of flexibilities and compressibilities of stable elastomeric block polymer gels. A film is provided for encapsulating the elastomer and the film includes physical properties of flexibility to enable uninhibited flexure and compression of the elastomer by a user. Decorative printing is disposed on a film interior side facing the elastomer in order to provide photo-like logos and decorations to the cushion, while having a film exterior surface resistant to abrasion and enabling cleaning thereof without affecting the decorative pattern. Printing of the film is effected by heat contacting the film with a printed paper.

12 Claims, 1 Drawing Sheet

FIG. 1.
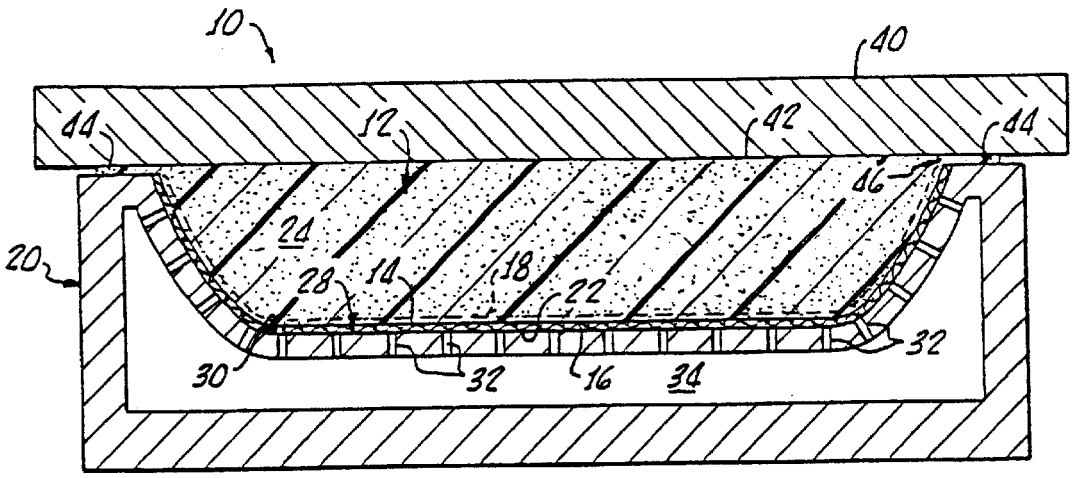
FIG. 2.
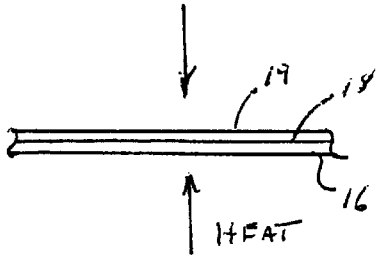
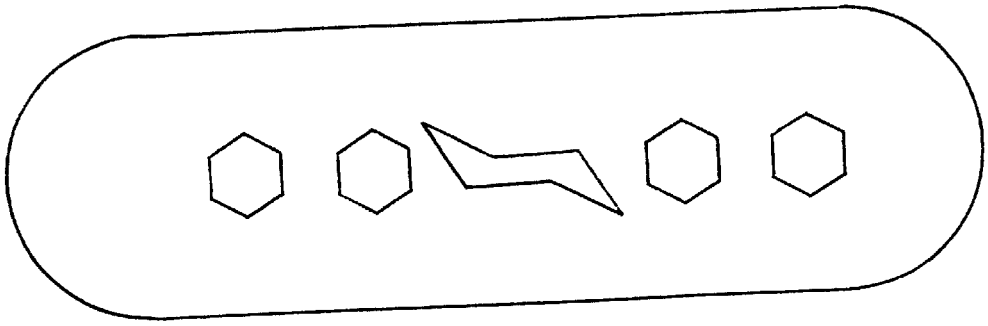
FIG. 3

METHOD OF APPLYING PRINT TO AN ELASTOMER AND DECORATIVE ELASTIC CUSHION

This application is a division of U.S. patent application Ser. No. 09/286,948 filed Apr. 8, 1999, now U.S. Pat. No. 6,314,598.

The present invention generally relates to the application of decorative print to an elastic and is more particularly directed to a decorative elastic cushion or pad made in accordance with the method of the present invention. A great number of elastic cushions and pads have been manufactured for a wide spread number of applications.

In many instances, the cushion is utilized in combination with other devices, such as in connection with the operation of a computer keyboard or the like. Accordingly, such cushions occupy a prominent position on a user's desk, or the like. This leaves the desirability of providing decoration for the cushion, which is observed by the user on a day-to-day basis. Even more particularly, the decorative pattern may be in the form of a company logo, or other advertisement of product and, in such an embodiment, the cushion becomes a constant reminder of a manufacturer's products.

Other cushions also are positioned and used in situations where the decorative pattern thereon provides a dominant feature of the cushion. For example, seat cushions for bicycle saddles, because of their dominant position, can provide an excellent decoration or medium for the introduction of company logos and advertisements to the bicycle rider.

In connection with two of the hereinabove cushions, which should be considered only an example of cushion which can benefit from the present invention, it is most desirable if the decorative pattern were a print of the highest quality, for example, a photographic type printing.

The present invention provides a unique method to produce a resilient cushion which includes near photo quality, in terms of both definition and color.

SUMMARY OF THE INVENTION

A decorative elastic cushion in accordance with the present invention generally includes an elastomer having the physical properties of flexibility and compressibility in the range of flexibilities and compressibilities of stable elastomeric block polymer gels.

Film means is provided for encapsulating the elastomer with the film means having the physical of flexibility to enable uninhibited flexure and compression of the elastomer by a user. Film means includes an exterior side and an interior side, with the latter facing the elastomer. The decorative printing is disposed on the film means interior side. In this manner, physical abuse or accumulated dirt and stains on the cushion, will not deter or detract from the decorative pattern, which may be a company logo, for example. Further cleaning of the external surface of the film means may be performed without fear of contaminating, fading, blurring, or otherwise affecting the decorative pattern which is printed on an inside surface of the film means.

In one embodiment of the present invention a backing film may be disposed between the film means interior side and the elastomer. The backing film also has the physical properties of flexibility to enable uninhibited flexure and compression of the elastomer by the user. The film means and the decorative printing may be transparent and accordingly, in accordance with the present invention, the backing film may include means, which defines a color of the backing film, for providing a background for the decorative printing. More particularly, it has been found that when the film means comprises a urethane having a thickness of between about 1 mil and about 5 mil, the flexure and compression of the elastomer is uninhibited.

Further, in accordance with the present invention, means may be provided which define embossment on the film exterior side which provides a texture to the decorative elastic cushion, for example, a leather texture.

A method in accordance with the present invention, for making a decorative cushion, includes the steps of providing an elastomer having the physical properties of flexibility and compressibility in the range of flexibilities and compressibilities of a stable elastomeric block polymer gel. A transparent film is provided for encapsulating the elastomer and the film includes the physical properties of flexibility to enable uninhibited flexure and compression of the elastomer by a user.

A decorative pattern is printed on an interior side of the film and the film is disposed in a mold with a film exterior side facing the mold. The printing may be effected through heated contact between a printed paper and the film. An elastomer is applied to the film interior surface to form an elastic cushion. Total encapsulation of the elastomer may be provided by wrapping and sealing portions of the film, extending outside of the mold to a backside of the elastomer.

BRIEF DESCRIPTION OF THE DRAWINGS

The present invention may be more clearly understood with reference to the following detailed description in conjunction with the appended drawings, of which:

FIG. 1 is a cross sectional view of apparatus suitable for practicing a method of making a decorative elastic cushion in accordance with the present invention;

FIG. 2 is a representation of a print transfer method in accordance with the present invention; and FIG. 3 is a plan view of the decorative elastic cushion with a visible logo thereon, made in accordance with the present invention.

DETAILED DESCRIPTION

With reference to FIG. 1, apparatus 10 is shown which is suitable for manufacturing a decorative elastic cushion in accordance with the present invention. It should be appreciated that other apparatus may be utilized in carrying out the method steps of the present invention. Reference is made to U.S. Pat. No. 5,679,193 for describing a suitable method for making an elastic cushion and this patent is incorporated herewith in its entirety for the purpose of describing suitable apparatus.

The present method for making a cushion 12 generally includes the steps of printing or coating one side of stretchable film, or fabric 6, to provide a decorative pattern 18, as also shown in FIG. 2.

Importantly, the elastomer 24 has the physical properties of flexibility and compressibility in the range of flexibilities and compressibilities of stable elastomeric block polymer gels, such as set forth in U.S. Pat. No. 3,676,387. This patent is incorporated herewith in its entirety for the purpose of describing a suitable type of gel for incorporation into the present invention.

Generally, the gels are of a polymer-oil combination and encapsulation thereof is important for providing both a tack free surface as well as preventing any leakage of plasticizing oil which may be utilized in the elastomer 24.

The transparent film 16 may be of any suitable type of plastic or fabric, capable of receiving print or transfer of pattern, such as, for example, urethane, or polyethylene. The film 16 thickness is preferably between about 1 mil and about 5 mils in order to encapsulate the elastomer 24, yet have resiliency which enables free gel-like movements, or compression, or depression of the elastomer 24, by a user (not shown).

When urethane is used as the film, a print 18 thereon may be effected by any suitable printing or transfer method to provide various designs and logos which may include printing type and various colors of near-photo quality type.

With urethane, it has been found most suitable to effect the printing through the heated contact of a printed sheet 19 with the urethane film 16, see FIG. 2. In this instance, heating of printed paper 19, when in contact with the urethane film 16 to a temperature of up to about 200° F. causes transfer of the print to the urethane film 16 and a complete bonding, or adhesion, of the transferred ink 18 to the urethane film 16. It has been found that heating to about 275° F. effects complete transfer of the ink.

The printed paper may be a suitable medium such as, for example, stock printed with commercially available inks in any variety of print fonts, designs, logos, and/or graphics of any color or style. Photograph quality graphics on the paper 19 results in a near photograph transfer of the ink 18, or image, onto the urethane film 18.

After printing, the film 16 is disposed over a mold 20 and a vacuum may be applied between the film 16 and the mold 20 in order to cause intimate contact between an unprinted exterior side 22 of the film 16.

Alternatively, the film 16 may be laminated to the elastomer 12 in accordance with the method set forth in copending U.S. Pat. No. 6,413,609 entitled, ELASTOMERIC FILM LAMINATED CUSHION AND LAMINATION METHOD. This referenced application is to be incorporated herewith in its entirety for the purpose of teaching a method of bonding or laminating the film 16 to the elastomer 12. It has been found that this referenced lamination procedure provides a cushion less likely to experience film 16/elastomer 12 separation over extended periods of cushion 10 use.

The mold 20 may be textured or having a molding surface 28 with a selected contour for embossing a pattern onto the exterior side 22 of the film 16. This texture may be, for example, of any type, but preferably, a grained leather type of embossment.

Preferably, the film is transparent and the printing 18 may also be transparent. This enables a backing material 32, which also may be urethane or polyurethane of between about 1 mil and about 5 mils, 32. A backing film 32 may include a color which provides a background for the decorative printing 18 which can be seen through the film 16.

While not always necessary and, of course, depending upon the desired mode of application of the elastomer 24 to the film 16, the mold 20 may be adapted for vacuum forming in any suitable, conventional manner. For example, the mold 20 may include vacuum ports 34 through the molding surface 28 and in combination with a hollow cavity 36, to which a vacuum may be applied. Alternatively, the elastomer may be applied to the film 16 by injection molding or the like.

The completed elastomer cushion 12 is now ready for removal from the mold 20. The step of removing the solidified gel 12 and the film 16 affixed thereto may be performed by placing a rigid mat 40 flat against the mold 20 in order to cause contact between the rigid mat 40 and an exposed surface 46 of the solidified elastomer. The tackiness of the solidified elastomer 24 will cause it to adhere to the rigid mat 40, and upon lifting the mat 40 from the mold, the elastomer cushion is lifted as well.

Next, the elastomer may be manually or otherwise peeled from the mat 40 and subsequently used in combination with other structure, such as a bicycle seat saddle, or by itself as a keyboard wrist support.

Portions of 44 of the film 16 may be sealed to an underside 46 of the elastomer 12 or removed, depending upon whether the cushion 12 is to be used in conjunction with additional support, as hereinabove noted, or as a self-standing cushion.

Although there has been hereinabove described an elastic cushion and a method of manufacturing same, in accordance with the present invention, for the purpose of illustrating the manner in which the invention may be used to advantage, it will be appreciated that the invention is not limited thereto. Accordingly, any and all modifications, variations or equivalent arrangements which may occur to those skilled in the art, should be considered to be within the scope of the invention as defined in the appended claims.

What is claimed is:

1. A method of making a decorative cushion comprising the steps of:

providing an elastomer having physical properties of elastomeric block polymer gels;

providing a film for encapsulating said elastomer, said film having physical properties of flexibility to enable uninhibited flexure and compression of said elastomer by a user, said film having an exterior side and an interior side;

printing a decorative pattern on the film interior side, said printing comprising contacting the film interior side with a printed paper and heating the film and paper in order to transfer ink, disposed on paper, onto the film;

disposing the film in a mold with the film exterior side facing the mold;

applying the elastomer to the film interior side to form an elastic cushion;

encapsulating the elastomer by wrapping and sealing portions of the film, extending outside of the mold, to a back side of the elastomer.

2. The method according to claim 1 wherein the step of providing a film comprises providing a urethane film and the step of heating the film and paper comprises heating the film and paper up to about 300° F.

3. The method according to claim 2 wherein the step of heating the film and paper comprises heating the film and paper to about 275° F.

4. The method according to claim 1 further comprising the step of disposing a backing film between the film and the elastomer.

5. The method according to claim 4 wherein said film is transparent and said backing film has a color for providing a background for said decorative printing.

6. The method according to claim 4 further comprising a step of embossing the film for providing a texture to the decorative cushion.

7. A method of making a decorative cushion comprising the steps of:

providing an elastomer having physical properties of stable elastomer block polymer gels;

providing a film for encapsulating said elastomer, said film having physical properties of flexibility to enable uninhibited flexure and compression of said elastomer by a user, said film having an exterior side and an interior side;

printing a decorative pattern on the film interior side, said printing comprising contacting the film interior side with a printed pattern and heating the film and paper in order to transfer ink, disposed on paper, onto the film;

disposing the film in a mold with the film exterior side facing the mold;

bonding the elastomer to the film interior side to form an elastic cushion;

encapsulating the elastomer by wrapping and sealing portions of the film, extending outside of the mold, to a back side of the elastomer.

8. The method according to claim 7 wherein the step of providing a film comprises providing a urethane film and the step of heating the film and paper comprises heating the film and paper up to about 300° F.

9. The method according to claim 8 wherein the step of heating the film and paper comprises heating the film and paper to about 275° F.

10. The method according to claim 7 further comprising the step of bonding a backing film between the film and the elastomer.

11. The method according to claim 10 wherein said film and decorative printing are transparent and said backing film has a color for providing a background for said decorative printing.

12. The method according to claim 10, further comprising a step of embossing the film for providing a texture to the decorative cushion.

* * * * *